United States Patent [19]

Clayton

[11] 4,223,740

[45] Sep. 23, 1980

[54] FIRE FIGHTING NOZZLE UNITS

[76] Inventor: Maurice A. Clayton, 12235 S. Stewart, Chicago, Ill. 60628

[21] Appl. No.: 904,423

[22] Filed: May 10, 1978

[51] Int. Cl.[2] ..... A62C 31/02

[52] U.S. Cl. ..... 169/70; 169/68; 239/208; 239/396; 52/168; 52/221; 285/3; 285/64

[58] Field of Search ..... 169/43, 46–47, 169/54, 68, 57, 16, 70; 239/208, 282, 396, 590; 52/168, 221; 285/64, 2–4, 208

[56] References Cited

U.S. PATENT DOCUMENTS

| | | | |
|---|---|---|---|
| 136,687 | 3/1873 | Woodman | 169/70 |
| 635,601 | 10/1899 | Schlosser | 169/70 |
| 765,760 | 7/1904 | Zetty | 169/70 |
| 2,535,311 | 12/1950 | McGann, Jr. | 169/70 |
| 2,789,010 | 4/1957 | Dean | 239/396 X |
| 2,807,479 | 9/1957 | Hixon | 169/70 X |
| 3,702,175 | 11/1972 | Watkins | 239/590 X |

*Primary Examiner*—Charles A. Marmor
*Attorney, Agent, or Firm*—Le Blanc, Nolan, Shur & Nies

[57] ABSTRACT

A method of fire fighting wherein open ended nozzle units are mounted in high rise or like building walls so that fluid conduits may be coupled from outside the room or space containing a fire within the building. This provides a special building structure wherein opposite ends of nozzle units may be accessible from different rooms, and the nozzle units are tubular bodies containing internally formed insert tubes defining the fluid flow pattern.

11 Claims, 6 Drawing Figures

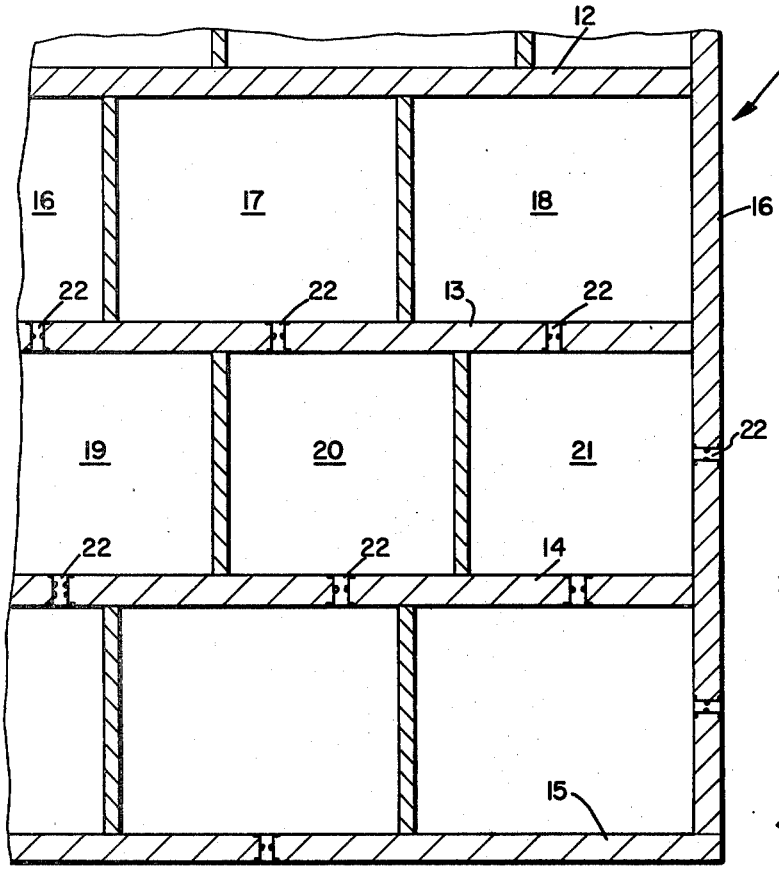
FIG.1
FIG.3
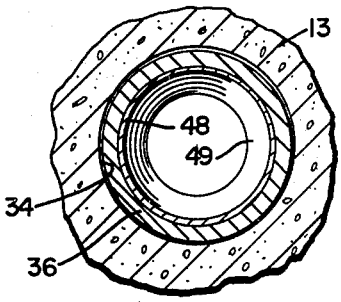
FIG.4
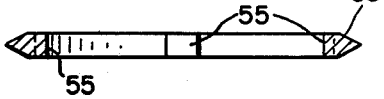
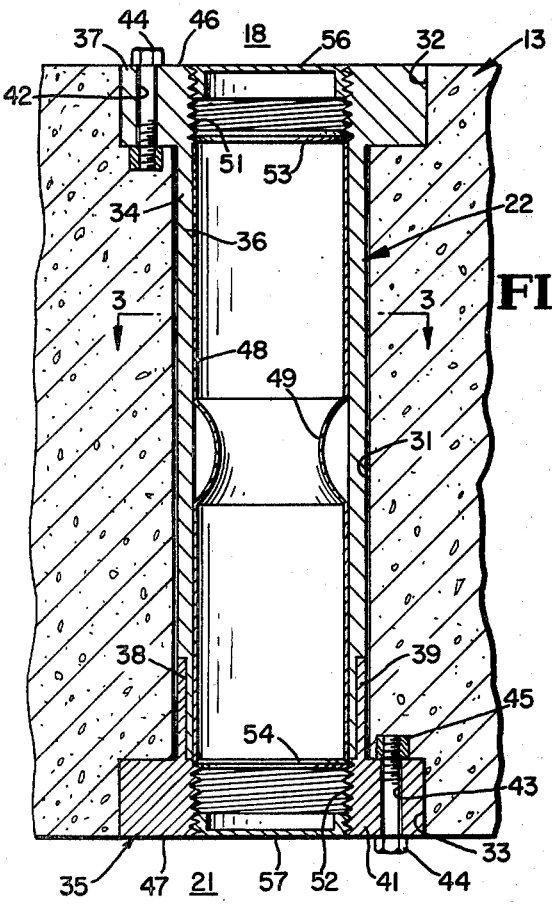
FIG.2
FIG.5
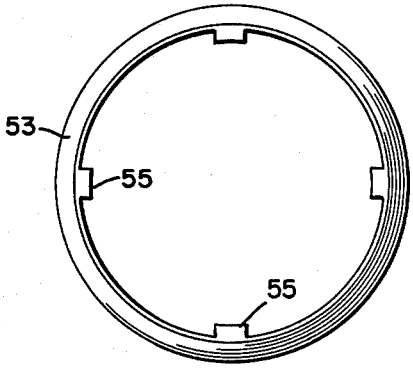
FIG.6
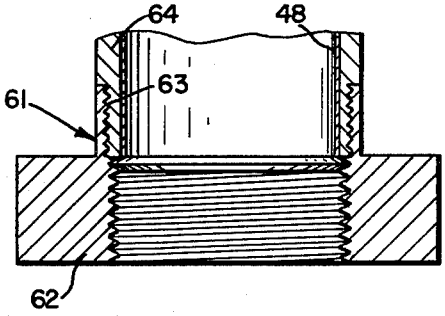

FIRE FIGHTING NOZZLE UNITS

This invention relates to fire fighting equipment and methods and is particularly concerned with equipment and methods for fighting fires the present difficulties of access such as in high rise apartments and business buildings of five or more floors.

In practice today most fires in such buildings are fought from either above or below the room or rooms wherein the fire is located, the firemen climbing or descending stairs to gain entry at room doors or the like or entering through windows from ladders. This is time consuming and not altogether satisfactory especially in fires at several building levels. Some fires are fought by remote methods such as breaking windows and pouring in water haphazardly. Others are more directly fought by firemen wearing asbestos suits and smoke masks entering the rooms containing the fire but this is dangerous and the heavy asbestos suits hamper movement of the men. In most buildings today sprinkler systems required by law are installed in specified areas, these systems acting automatically to spray water over an area when rising temperature fuses spray nozzle controls, and in some instances these sprinkler systems may be connected to an outdoor standpipe that enables firemen to attach a hose outside the building and pump water in through the entire sprinkler system. These systems are costly to install and are subject to accidental and excessive area discharge of water.

The present invention which may be used in place of or in conjunction with required sprinkler systems, provides a more direct and safe method of fighting fire, with attendant possibilities of smoke and gas removal, adaption to chemical systems and localized control.

It is a major object of the invention to provide a novel system and method of fire fighting particularly for high rise buildings wherein externally accessible open ended nozzle units are built into one or more of walls whereby water or chemical introduction hoses or exhaust conduits may be selectively attached for selectively treating a fire, smoke or flooding condition within a room or space.

A further object of the invention is to provide a novel nozzle unit for mounting in room walls and the like comprising a tubular body containing an insert tube shaped to impart a desired flow condition to fluid passing through it. Pursuant to this object the body is formed at opposite ends to provide for quick coupling to water or chemical supply hoses, and its opposite ends are normally closed by covers that may blow out under internal fluid pressure.

Another object of the invention is to provide a building structure wherein the foregoing nozzle units are mounted in a selected wall or walls of a room or space with the outer ends accessible for attachment of a hose.

BRIEF DESCRIPTION OF DRAWINGS

FIG. 1 is a diagrammatic view showing location of nozzle units of the invention in high rise building walls;

FIG. 2 is an enlarged view mainly in section showing a preferred form of nozzle unit;

FIG. 3 is a section on line 3—3 of FIG. 2;

FIGS. 4 and 5 are side elevational and plan views respectively of an insert holding washer for the unit of FIG. 2; and FIG. 6 is a fragmentary view showing an alternate structure of the nozzle unit;

PREFERRED EMBODIMENTS

Referring to FIG. 1 a vertical cut through a high rise building 11 exhibits horizontal walls 12–15 and a side wall 16. The horizontal walls represent the respective floors and ceilings for the rooms at different levels. For example wall 13 represents the floor of rooms 16–18 above it, and the ceiling of rooms 19–21 below it. The invention is not limited to any particular floor or ceiling structure.

The nozzle units of the invention, which may all be of the same structure, or may vary according to desired water flow in different parts of the building, are indicated at 22. For example room 21 has a ceiling nozzle, a floor nozzle, and a side wall nozzle. Any desired distribution of nozzles is within the scope of the invention.

One form of nozzle unit 22 mounted in wall 13 is shown in detail in FIGS. 2 and 3. The wall 13 which is the ceiling of room 21 and the floor of room 18 is formed with a vertical bore 31 opening at opposite ends into countersunk recesses 32 and 33. The unit comprises an upper hollow element 34 inserted from the floor of room 18 and a lower hollow element 35 inserted from the ceiling of room 21.

As shown element 34 may comprise a stiff tubular metal or plastic body 36 extending through bore 31 and an integral upper enlarged flange 37 fitting into recess 32. The lower end of body 36 is externally reduced in diameter at 38 to fit telescopically with a collar 39 upstanding from an enlarged flange 41 fitted into recess 31. Where they are telescoped body 36 and collar 39 provide a section of uniform diameter and wall thickness that is effectively a continuation of body 36. Preferably body 36 is of uniform diameter and flanges 37 and 41 are similar so that the unit may be mounted in reverse position from that shown in FIG. 2.

Flanges 37 and 41 may be formed with bolt holes 42 and 43 through which extends bolts such as that shown at 44 to fit their threaded ends into ferrules or the like 45 anchored in the wall 13. When bolts 44 are tight the open ended unit is fixed in place on wall 13.

As shown the exposed end surfaces 46 of flanges 37 and 47 of flange 41 are preferably flat and flush with the floor of room 18 and the ceiling of room 21 respectively.

Internally body 36 is lined with a separate stiff tube insert 48 which may be internally formed, as by an inwardly projecting rounded cross-section rib 49, to provide a flow modifying restriction. The respective end flanges of the unit are internally threaded at 51 and 52, and insert holding devices in the form of annular washers 53 and 54 having their tapered peripheral edges formed to mesh with the threads are screwed in through the flanges until they engage opposite ends of tube 48. As shown in FIGS. 4 and 5 each washer may have an internal diameter slightly less than the inner diameter of tube 48 and a series of circumferentially spaced lugs 55 projecting inwardly to abut the end edges of tube 48.

Tubes 48 which may be formed of relatively thin sheet metal or a suitable stiff synthetic plastic are removable and replaceable, and they are modified internally to provide any desired water flow characteristics.

The threads at 51 and 52 are selected to correspond with the threaded ends of fire hose nozzles that are used in a particular district. They may be of any form and preferably are of the quick coupling type whereby a simple twist will anchor the hose end in the flange.

Preferably also frangible plastic or like covers 56 and 57 are mounted, as by threading onto the flanges. The cover 56 which is flush with the room floor is strong enough to withstand normal blows such as a person walking on the floor. Both covers are readily removable, for attachment of a hose coupling into the particular flange, and the threaded engagement is sufficiently weak for each cover that when one cover is removed to attach a hose the opposite cover may at once be blown out by water pressure.

The fit of the unit body 36 within bore 31 should be fairly loose as shown exaggeratedly in FIG. 2, so that deformation of concrete or other material in the wall does not deform or damage the flow control characteristics of the unit. Preferably tube 48 is of thin gage corrosion resistant stainless steel or alloy steel that will be non-buckling and otherwise dimensionally stable up to 1000° F. Washers 53 and 54 are preferably of corrosion resistant material.

The invention may take many physical forms. For example the collar 61 on the shorter end flange 62 may have threaded engagement at 63 with the reduced lower end of the unit body 64 as shown in FIG. 6. This may eliminate the need for bolt holes in the flanges, as tightening of the threaded connection will clamp the unit to the wall.

In some forms of the invention the irregularities and/or flow restrictors or modifiers may be formed integrally with body 36 so that the washers 53 and 54 are not used. However for inventory and for purposes of providing the correct flow at each unit, the insert tubes are separate removable and replaceable elements.

In practicing the invention, assume that a fire breaks out in room 21 of FIG. 1. The firefighters have the option of connecting a hose into the wall, ceiling and/or side wall nozzle units, To do this they would for example remove the outer end cover of the selected nozzle unit, which might be cover 56 in the floor of room 18, couple the hose into flange 37 and turn on the water. The water pressure blows out cap 57 and water will flow into room 21 modified according to the restrictions or other formations in tube 48. The firefighter need not enter the room until a relatively safe condition is established.

The tube 48 may be modified in internal shape to provide steady water flow, special patterns of flow or spray, or even intermittent busts which would reduce water consumption.

The invention adapts itself to more than mere water flow control. For example some fires such as electrical fires may require chemicals to be sprayed into the room or space containing the fire. Here adapters can be provided for coupling the chemical discharge hoses into the selected unit 22.

Further the units 22 can be used to facilitate smoke and fume removal from a room or space, to contribute to safety in entering. Actually this principal of exhausting the room atmosphere could help to reduce the fire since it removes oxygen containing air. This can be done by attaching a vacuum pump conduit to the outer end of a selected unit. The floor unit can also for example be coupled to an exhaust pump for reducing and draining flooding in a room. It is possible even to pump air or oxygen into a room isolated from the fire but containing a trapped person.

The nozzle units such as at 22 can be constructed relatively inexpensively and may be installed either in new construction or readily installed in existing buildings.

The invention may be embodied in other specific forms without departing from the spirit or essential characteristics thereof. The present embodiments are therefore to be considered in all respects as illustrative and not restrictive, the scope of the invention being indicated by the appended claims rather than the foregoing description, and all changes which come within the meaning and range of equivalency of the claims are therefore intended to be embraced therein.

What is claimed and desired to be secured by Letters Patent is:

1. In a building structure comprising a series of rooms, each room having a ceiling wall, a floor wall and side walls, a flow control nozzle unit mounted in at least one of said walls, said unit being accessible externally of the room and formed at its end outside the room for coupling to a fluid conducting conduit and a cover on the inner end of said nozzle unit substantially flush with the adjacent wall surface, said cover being removable and having such weakened connection to the nozzle unit that it will be blown out by fluid pressure within the unit when a fluid supply hose is coupled to the other end of the unit.

2. In the building structure defined in claim 1, the ceiling wall of at least one of said rooms being common with the floor wall of the adjacent room directly above it, and there being a nozzle unit in that common wall with its opposite ends opening into the respective rooms, and each end of the unit being formed for coupling to a fluid conducting conduit whereby a fire in either room may be fought by firefighters in the adjacent room.

3. A nozzle unit for installation in a wall of a building space, said nozzle unit comprising a tubular body adapted for mounting to extend through an opening in said wall with its opposite ends openable and accessible at either side of the wall and with at least the outer end formed with means for coupling a fluid conducting supply conduit to said unit, and means mounting a cover on the inner end of said body including a frangible connection providing for the cover being blown off the body by pressure of fluid delivered from a conduit connected to said outer end of the body.

4. The nozzle unit defined in claim 3 wherein both ends of the unit are formed for coupling a fluid conducting conduit.

5. The nozzle unit defined in claim 3, wherein said body contains a removable and replaceable insert tube internally formed to define a flow passage imparting a desired flow pattern to fluid passing therethrough.

6. The nozzle unit defined in claim 3, wherein said coupling means comprises an internally threaded end of said body, and said cover is frangible and mounted in said threaded end.

7. In a building structure comprising a series of rooms at different levels, each room having a ceiling wall and a floor wall and flow control nozzle units mounted in said walls, each of said units being accessibly openable externally of the room and formed there for coupling to a fluid conducting conduit, the ceiling wall of at least one of said rooms being common with the floor wall of the adjacent room directly above it, and there being a nozzle unit in that common wall with its opposite ends opening into the respective rooms, and each end of the unit being formed for coupling to a fluid conducting conduit whereby a fire in either room may be fought by firefighters in the adjacent room, covers on the ends of the nozzle units substantially flush with the wall surfaces in the respective rooms, said covers being removable and each cover having such connection to the nozzle that it willbe blown out by fluid pressure within the unit when a fluid supply hose is coupled to the other end of the unit.

8. In a building structure comprising a room having a ceiling wall, a floor wall and side walls, a flow control nozzle unit mounted on at least one wall of said room, with one end opening into the room and its opposite end opening externally of the room, and said opposite end of the unit being formed for coupling to a fluid conducting conduit, a cover mounted on said one end of the nozzle unit substantially flush with the side wall surface within said room, said cover having such relatively frangible connection to the nozzle unit that it will be blown out by fluid pressure within the unit when subjected to water pressure exerted by a fluid supply hose coupled to said opposite end of the unit.

9. A nozzle unit for installation in the wall of a room or other space, said nozzle unit comprising a tubular body adapted for mounting to extend through an opening in said wall with its opposite ends openable and accessible at either side of the wall and with at least the outer end formed with means for coupling a fluid conducting conduit to said unit, said body containing a removable and replaceable insert tube internally formed to define a flow passage imparting a desired flow pattern to fluid passing therethrough and said body comprising similar end flanges adapted to seat upon opposite sides of said wall and being internally formed with coupling elements for connection with said conduit.

10. A nozzle unit for installation in the wall of a room or other space, said nozzle unit comprising a tubular body adapted for mounting to extend through an opening in said wall with its opposite ends openable and accessible at either side of the wall and with at least the end at the outer side of the wall being formed with means for coupling a fluid conducting conduit to said unit, said body comprising detachably interconnected axially separable tubular opposite end portions, a preformed flow control liner tube extending through the body, and linear holding means on said tubular portions, both of said tubular end portions of said body having internal threads providing for coupling of a fluid conduit, and said liner holding means being located axially inwardly of said threads in abutment with the ends of the liner.

11. The nozzle unit defined in claim 10 wherein said liner tube is of synthetic plastic and formed intermediate its ends with a flow control restricted region.

* * * * *